United States Patent [19]

Howlett

[11] Patent Number: 5,056,449

[45] Date of Patent: Oct. 15, 1991

[54] SAIL BATTEN

[76] Inventor: Ian C. Howlett, Chestnut Cottage, Beaulieu, Hampshire SO42 7YB, England

[21] Appl. No.: 508,155

[22] Filed: Apr. 11, 1990

[30] Foreign Application Priority Data

Apr. 12, 1989 [GB] United Kingdom ..... 8908280

[51] Int. Cl.[5] ..... B63H 9/04

[52] U.S. Cl. ..... 114/103; 114/107; 114/39.1

[58] Field of Search ..... 114/102, 103, 39.1, 114/107

[56] References Cited

U.S. PATENT DOCUMENTS

| | | | |
|---|---|---|---|
| 2,608,172 | 8/1952 | Biuw | 114/103 |
| 3,905,321 | 9/1975 | Blythe, Jr. | 114/103 |
| 4,487,146 | 12/1984 | Parmentier | 114/102 |
| 4,633,798 | 1/1987 | Skinner et al. | 114/103 X |
| 4,864,953 | 9/1989 | Allsopp et al. | 114/103 |

FOREIGN PATENT DOCUMENTS

| | | |
|---|---|---|
| 0087194 | 2/1983 | European Pat. Off. . |
| 0233129 | 1/1987 | European Pat. Off. . |
| 2167335 | 1/1972 | France . |
| 639952 | 10/1947 | United Kingdom . |
| 965204 | 7/1963 | United Kingdom . |
| 1316659 | 12/1970 | United Kingdom . |

*Primary Examiner*—Ed Swinehart

*Attorney, Agent, or Firm*—Notaro & Michalos

[57] ABSTRACT

A sail batten for use in stiffening a sail comprises an elongate rectangular member (10) provided in its mid region with a channel section portion (11) which rises from one surface (12) of the batten, the channel section gradually decreasing in height from one end of the batten to the other so that the stiffness of the batten varies along its length.

9 Claims, 1 Drawing Sheet

SAIL BATTEN

FIELD AND BACKGROUND OF THE INVENTION

This invention relates to a sail batten for use in stiffening a sail of a sailing vessel, such as a yacht, or a vessel provided with auxiliary sail propulsion.

It is known to stiffen a sail by inserting battens into pockets provided on the sail. Such battens are usually elongate members rectangular in cross-section along the whole of their length.

SUMMARY OF THE INVENTION

According to the present invention there is provided a sail batten for use in stiffening a sail, comprising an elongate rectangular section member provided in its mid region with a channel section portion which rises from one surface of the batten, said channel section gradually decreasing in height from one end of the batten to the other end so tat the stiffness of the batten varies along its length.

The channel section may also gradually decrease in width from one end to the other.

Preferably the channel section has outwardly inclined side walls.

BRIEF DESCRIPTION OF THE DRAWINGS

An embodiment of the invention will now be described, by way of example, with reference to the accompanying drawings, in which.

The batten is indicated generally at 10 and comprises a one piece elongate member of generally rectangular cross-section provided in its mid width region with a channel section portion 11 which rises from one surface 12 of the batten 10. The channel section portion 11 has outwardly inclined side walls 13 and it gradually decreases in height from one end to the other so that the stiffness of the batten 10 varies along its length.

The batten 10 is preferably formed of fibre reinforced plastics material or metal. The reinforcing fibres may be glass, carbon or aramid fibres such as KEVLAR (Registered Trade Mark).

Thus, a batten 10 is produced which is light in weight with the required stiffness variation. The stiffness of the batten 10 can be adjusted according to the chosen geometry of the channel section portion 11. The channel section portion 11 may have any other desired cross-section. For example it can be arcuate.

Figure 3:
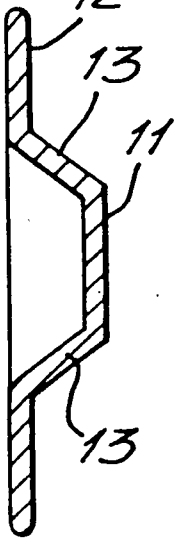
FIG. 3 is a transverse section on an enlarged scale taken along the line 3—3 of FIG. 1.
Figure 4:
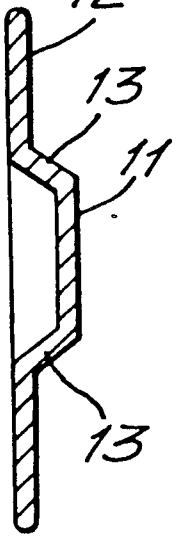
FIG. 4 is a transverse section on an enlarged scale taken along the line 4—4 of FIG. 1.

In the embodiment of FIG. 3, the channel section is trapezoidal in cross-section with a decreasing height and decreasing width.

Figure 1:
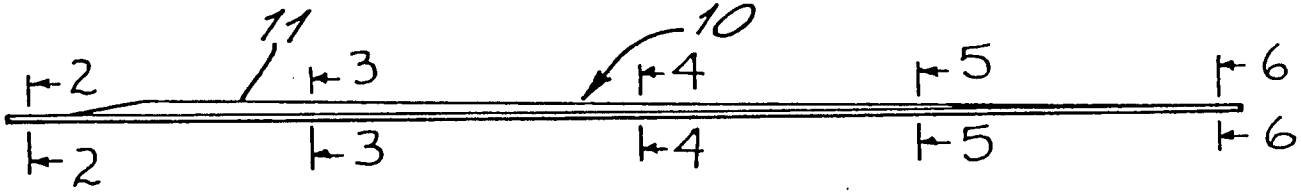
FIG. 1 is a side elevation of a batten according to the present invention.
Figure 2:
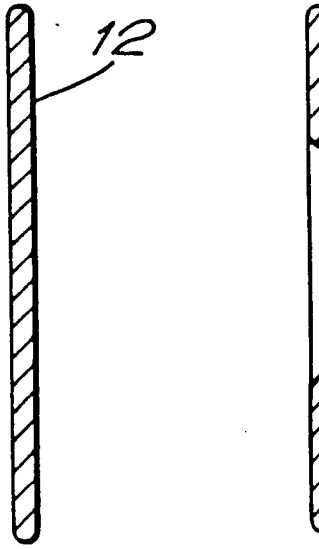
FIG. 2 is a transverse section on an enlarged scale taken along the line 2—2 of FIG. 1.
Figure 5:
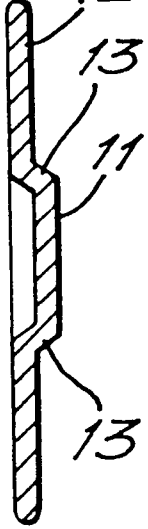
FIG. 5 is a transverse section on an enlarged scale taken along the line 5—5 of FIG. 1.
Figure 6:
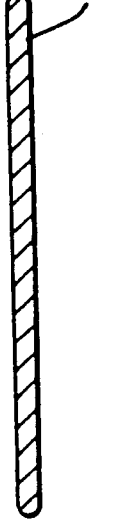
FIG. 6 is a transverse section on an enlarged scale taken along the line 6—6 of FIG. 1

The one piece member which forms the batten of the invention, also has flat side sections, on opposite elongated sides of the channel section portion 11, which lie in the plane of the batten. By comparing FIGS. 1, 2 and 6, it is seen that the batten also has flat end sections at opposite ends of the channel, with the channel abruptly increasing in height at one end of the batten (see FIG. 3 for example) and decreasing gradually in height and width toward the opposite end of the batten (see FIG. 5 for example).

I claim:

1. A sail batten for use in stiffening a sail, comprising a one piece elongate member having a rectangular section, lying in a plane and having opposite sides, opposite surfaces extending between the opposite sides, and opposite ends, the one piece member having a mid width channel section portion rising from only one surface of the member, and out of the plane of the member, the channel section portion gradually decreasing in height from one end of the member to the opposite end of the member so that the stiffness of the member varies along the length of the member from its one end to its opposite end, the member including side sections extending along the opposite sides of the member, on opposite sides of the channel section portion.

2. A sail batten as claimed in claim 1 wherein the side sections on opposite sides of the channel section are flat and

3. A sail batten according to claim 2, wherein the channel section is trapezoidal, and including outwardly inclined side walls, one side wall extending to each of the flat side sections of the member, the side walls gradually decreasing in width from one end of the member to the opposite end of the member so that the channel section portion gradually decreases in height from one end of the member to the opposite end of the member.

4. A sail batten according to claim 3, wherein the member includes flat end sections at the opposite ends of the batten, and on opposite ends of the channel section, the channel section portion increasing rapidly from one flat end section to a maximum height for the channel section portion, and then decreasing gradually from the maximum height to the opposite flat end section of the member.

5. A sail batten as claimed in claim 2, in which the channel section portion has outwardly inclined side walls connected to the flat side sections.

6. A sail batten according to claim 1, wherein the channel section portion increases rapidly from one end of the member to a maximum height for the channel section portion, and thereafter decreases gradually toward the opposite end of the member, the member including flat end sections on opposite ends of the member and at opposite ends of the channel section portion.

7. A sail batten as claimed in claim 1, in which the channel section gradually decreases in width from one end to the other.

8. A sail batten as claimed in claim 1, formed of fibre reinforced plastics material.

9. A sail batten as claimed in claim 1, formed of metal.

* * * * *